US009657491B1

(12) United States Patent
Mansueto

(10) Patent No.: US 9,657,491 B1
(45) **Date of Patent: *May 23, 2017**

(54) POLE-TYPE MEMBER SUPPORT DEVICE AND METHOD THEREFOR

(71) Applicant: Raul Mansueto, Las Vegas, NV (US)

(72) Inventor: Raul Mansueto, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/002,142

(22) Filed: Jan. 20, 2016

(51) Int. Cl.
*F16M 13/00* (2006.01)
*E04H 12/22* (2006.01)
*A47G 33/12* (2006.01)

(52) U.S. Cl.
CPC ..... *E04H 12/2238* (2013.01); *A47G 33/12* (2013.01); *E04H 12/2269* (2013.01)

(58) Field of Classification Search
CPC ..... A47G 33/12; A47G 2033/1286; E04H 12/2238
USPC ..... 248/524, 523, 519, 511
See application file for complete search history.

(56) References Cited

U.S. PATENT DOCUMENTS

| | | | | |
|---|---|---|---|---|
| 5,704,580 | A * | 1/1998 | Peery, Jr. | E01F 9/623 248/345 |
| 6,745,991 | B1 * | 6/2004 | Rush | A47G 33/12 248/523 |
| 7,930,854 | B1 * | 4/2011 | Zaverousky | A47G 33/12 47/40.5 |
| 8,091,853 | B2 * | 1/2012 | Clores | A47G 33/12 248/523 |
| 2016/0186456 | A1 * | 6/2016 | Mansueto | E04H 12/2238 248/523 |

* cited by examiner

*Primary Examiner* — Todd M Epps
(74) *Attorney, Agent, or Firm* — Weiss & Moy, P.C.; Jeffrey D. Moy

(57) ABSTRACT

A pole type member support device has a receptacle having an opening formed in a top section thereof. The receptacle is tapered so that the top section of the receptacle is smaller than a bottom section of the receptacle. A tubular cut-out is formed within the receptacle and extends down from the opening. The tubular cutout is tapered so that the top section of the tubular cut-out is larger than a bottom section of the tubular cut-out. An adapter is positioned within the tubular cut-out. The adapter is configured to hold a pole-type member in an upright position.

18 Claims, 6 Drawing Sheets

POLE-TYPE MEMBER SUPPORT DEVICE AND METHOD THEREFOR

FIELD OF THE INVENTION

This invention relates generally to pole-type member supporting devices and methods and, more particularly, to a pole-type member support device and method for securely supporting Christmas trees, artificial trees, umbrellas, and other elongated objects in an upright position for an extended period of time.

BACKGROUND OF THE INVENTION

During the holiday season, many people set up real and/or artificial Christmas trees in their homes for both decorative and religious purposes. The Christmas trees often vary in height and size, creating varying degrees of difficulty in supporting the trees in a stable position. Other people purchase or rent other types of trees, umbrellas, tiki torches, or other pole-type items for special events and occasions and/or everyday use or enjoyment. In these cases as well, it is difficult to support these items in a stable manner. Often, the result is that the trees, umbrellas, poles, or other items are either leaned against a wall or propped up in some other unstable way. This lack of a proper support device can lead to a number of unwanted consequences. A tree or umbrella falling from an unstable position can cause not only property damage but can also cause physical harm to a person. Likewise, a falling tiki torch or a pole-type item with a candle or other lit object on top could ignite a fire.

Previous attempts have been made to provide a support device for Christmas trees. For example, U.S. Pat. No. 5,970,655 issued to Freeman discloses a Christmas tree resting inside a collar member having a radial extension and a rod between the tree and the radial extension. The Freeman patent requires the attachment of a rod to a portion of the tree with set screws, a time-consuming and difficult process. The setting up of the rod assembly is a time-consuming and difficult process. Further, while natural, cut Christmas trees typically have trunks with flat bottom surfaces due to where they have been cut, the aforementioned pole-type members may lack flat bottom surfaces, particularly in instances where they are adapted to be staked into the ground, and would be prone to slipping in a support device like that of Freeman.

Another example is U.S. Pat. No. 5,137,246 issued to Idso. Idso discloses a stand for Christmas trees comprised of a base plate with a pair of spaced-apart upright brackets mounted thereon. The tree holder receptacle is pivotally mounted between the upright brackets so that it can move about a horizontal axis in order to orient the tree trunk to a generally vertical position. A pair of locking levers is associated with the upright brackets so that they can be releasably clamped to orient the tree holder receptacle in any desired position. A set screw is provided to accept the tree into the tree holder receptacle. Adjusting the set screw and the pair of locking levers in order to properly position the tree trunk is a time-consuming and difficult process.

Accordingly, there has been a need for a pole-type member support device which is of simplified construction, inexpensive to manufacture, simple to install, and that can securely hold Christmas trees and/or pole-type members of various diameters. The pole-type member support device would hold Christmas trees and/or a pole-type member in a fixed position for an extended period of time and which does not require the use of screw type locking devices to hold the Christmas trees and/or pole-type members in an upright position. It would thus be desirable to provide a pole-type member support device that addresses the aforementioned shortcomings of existing devices.

SUMMARY OF THE INVENTION

In accordance with an embodiment of the present invention, a pole-type member support device is disclosed. The pole type member support device has a receptacle having an opening formed in a top section thereof. The receptacle is tapered so that the top section of the receptacle is smaller than a bottom section of the receptacle. A tubular cut-out is formed within the receptacle and extends down from the opening. The tubular cutout is tapered so that the top section of the tubular cut-out is larger than a bottom section of the tubular cut-out. An adapter is positioned within the tubular cut-out. The adapter is configured to hold a pole-type member in an upright position.

In accordance with another embodiment of the present invention, a pole-type member support device is disclosed. The pole type member support device has a receptacle having an opening formed in a top section thereof. The receptacle is tapered so that the top section of the receptacle is smaller than a bottom section of the receptacle. A tubular cut-out is formed within the receptacle and extends down from the opening. The tubular cutout is tapered so that the top section of the tubular cut-out is larger than a bottom section of the tubular cut-out. An adapter is positioned within the tubular cut-out. The adapter is configured to hold a pole-type member in an upright position. The adapter comprises a plurality of holding members. The plurality of holding members is stacked together. Each of the plurality of holding members has a conical-shaped base member having a circular-shaped bottom surface. A sidewall extends up from the bottom surface and away from a central area of the bottom surface. The base member is tapered so that a top section of the base member is larger than a bottom section. A cylindrical-shaped vertical support member extends upwardly from the central area of the bottom surface and is configured to receive a portion of a pole-type member to hold the pole-type member in an upright position.

In accordance with another embodiment of the present invention, a pole-type member support device is disclosed. The pole type member support device has a receptacle having an opening formed in a top section thereof. The receptacle is tapered so that the top section of the receptacle is smaller than a bottom section of the receptacle. A tubular cut-out is formed within the receptacle and extends down from the opening. The tubular cutout is tapered so that the top section of the tubular cut-out is larger than a bottom section of the tubular cut-out. An adapter is positioned within the tubular cut-out. The adapter is configured to hold a pole-type member in an upright position. The adapter comprises a plurality of holding members. The plurality of holding members is stacked together. Each of the plurality of holding members has a conical-shaped base member having a circular-shaped bottom surface. A sidewall extends up from the bottom surface and away from a central area of the bottom surface. The base member is tapered so that a top section of the base member is larger than a bottom section. A cylindrical-shaped vertical support member extends upwardly from the central area of the bottom surface and is configured to receive a portion of a pole-type member to hold the pole-type member in an upright position. At least one ring member is provided. The ring member has a slot formed therein. The slot has a diameter approximately equal to a diameter of a pole-type member. The ring member is configured to be inserted and held within the tubular cut-out to support the pole-type member in an upright position within the tubular cut-out, wherein the at least one ring member is positioned on top of an uppermost base member of the adapter. A locking tab is slidable within the slot. The locking tab supports the pole-type member in an upright position within the slot.

BRIEF DESCRIPTION OF THE DRAWINGS

Embodiments of the disclosure will become more fully understood from the detailed description and the accompanying drawings, wherein.

Common reference numerals are used throughout the drawings and detailed description to indicate like elements.

DETAILED DESCRIPTION

Figure 1:
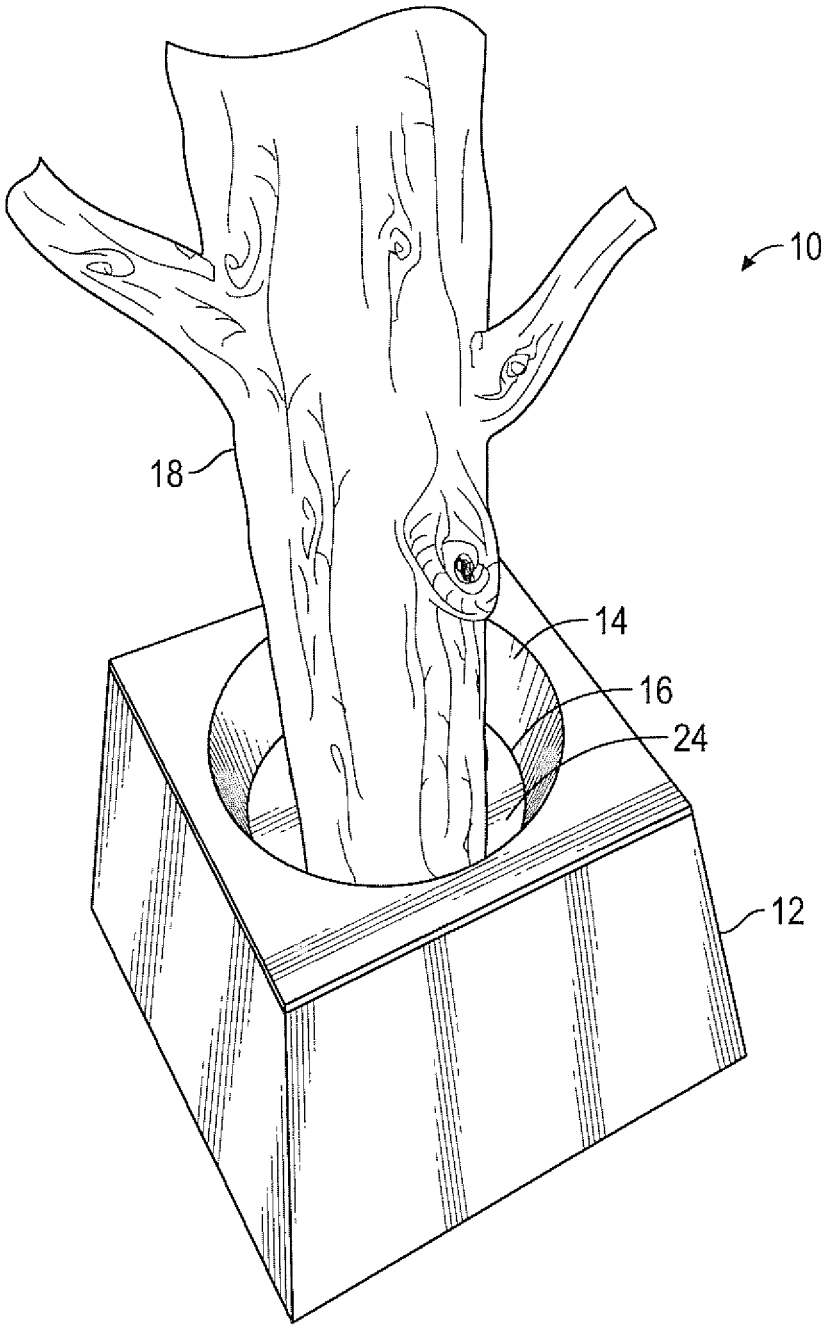
FIG. 1 is a perspective view of a stand for securing a pole-type member, in accordance with an embodiment of the present invention.
Figure 2:
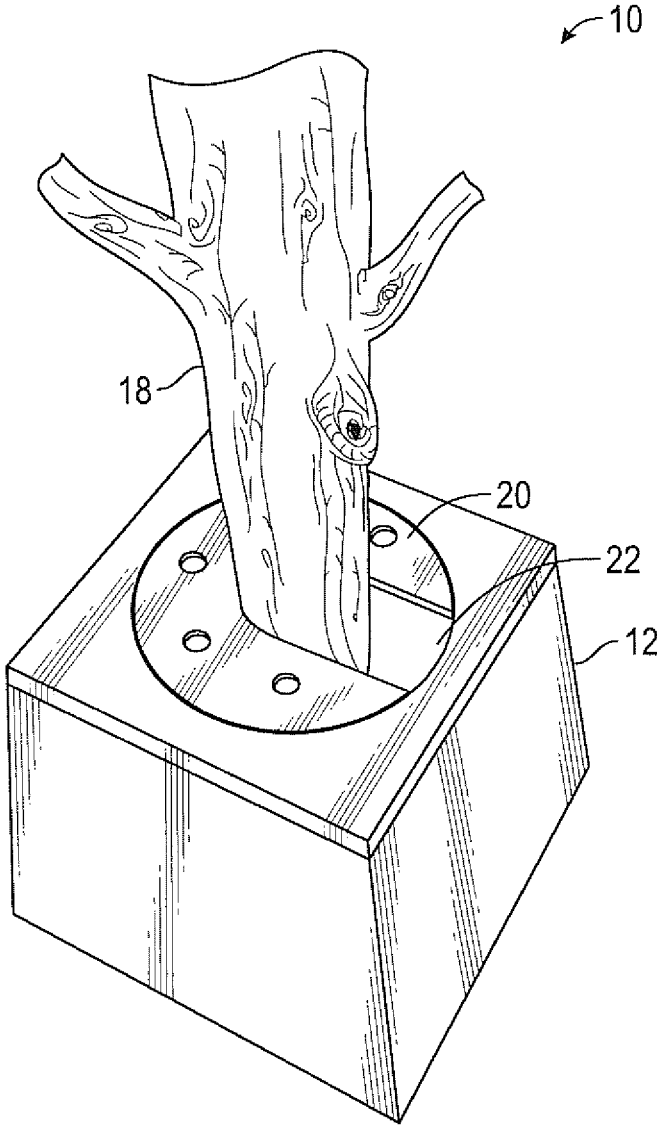
FIG. 2 is a perspective view of the stand with a top adapter ring supporting a pole-type member with a locking tab removed, in accordance with an embodiment of the present invention.

Referring to FIGS. 1-2, an embodiment of a stand 12 for securing a pole-type member 18, in accordance with an embodiment of the present invention may be shown. The stand 10 may comprises a receptacle body 12. The receptacle body 12 may be slightly tapered from a top section of the receptacle body 12 to a bottom section of the receptacle body 12 such that the top section is slightly smaller than the bottom section. The taper configuration provides a wider bottom surface for addition support. While FIGS. 1-2 show the receptacle body 12 being trapezoidal in shape, this is given as an example and should not be seen in a limiting manner.

The receptacle body 12 may have a pole receiving opening 14 formed in the top section therein. The opening 14 may be formed in a central area of the top section of the receptacle body 12. The opening 14 may be circular in shape but may be formed in other configurations without departing from the spirit and scope of the present discourse. The opening 14 may lead to a cut-out 16 formed in the interior of the receptacle body 12. In accordance with one embodiment, the cut-out 16 may be conical in shape. Thus, the cut-out 16 may be tapered in shape so that a top section of the cut-out 16 may be larger in diameter and/or width than the diameter and/or width of a bottom section of the cut-out 16. The opening 14 and cut-out 16 may be configured to receive a pole-type member 18 and for cooperatively holding the pole-type member 18 upright in the receptacle body 12. In accordance with one embodiment, the cut-out 16 may be enclosed. By having an enclosed cut-out 16, the cut-out 16 may be to store a liquid such as water.

The device 10 may come with one or more ring members 20. The ring members 20 may come in a plurality of different diameters. Since the cut-out 16 may be conical in shape, the plurality of ring members 20 may be inserted into and held within the cut-out 16. Thus, one or more ring members 20 may be sized to fit in a lower section of the cut-out 16, one or more ring members 20 may be sized to fit in a middle section of the cut-out 16, and one or more ring members 22 may be sized to fit in an upper section of the top section of the cut-out 16 so as to be approximately flush with a top surface of the receptacle body 12.

Each ring member 20 may have a slot 22 formed therein. The slot 22 may be "U" shaped and may be sized to fit around the pole-type member 18 having an approximately equal width.

A pole holding adapter 24 (hereinafter adapter 24) may be positioned within the cut-out 16. The adapter 24 may be used to hold and the support pole-type member 18 in an upright manner. In accordance with one embodiment, the adapter 24 may be similar in size and shape to the cut-out 16 to fit securely within the cut-out 16.

The adapter 24 may be comprised of one or more holding members 26. As may be seen in FIGS. 3A-4B, the holding members 26 may be stacked together as will be disclosed below. Each holding member 26 may be similar in size and shape to the cut-out 16. Thus, in accordance with one embodiment, each of the holding members 26 may be conical in shape so that a top diameter of the holding member 26 may be larger than a bottom diameter of the holding member 26.

The holding member 26 may include a bottom surface 28. The bottom surface 28 may be circular in shape. Sidewalls 30 may extend up and away from a central area of the bottom surface 28 to form a conical container having a hollow interior 32 having an open top area 34.

A vertical support member 36 may extend up from the bottom surface 28 of the holding member 26. The vertical support member 36 may extend up from a central area of the bottom surface 28 of the holding member 26 to an area below the open top area 34. In accordance with one embodiment, the vertical support member 32 may extend up from a central area of the bottom surface 28 of the holding member 26 to a height of approximately three-fourths of the way up to the open top area 30.

The vertical support member 32 may be cylindrical in shape, having a top opening 38. The top opening 38 may be circular in shape. The vertical support member 36 may be adapted to receive a portion of a pole-type member (not shown), including an artificial Christmas tree, some other type of artificial tree, an umbrella, a tiki torch, or some other elongated pole-type member. When such a pole-type member is positioned in the vertical support member 36, the vertical support member 36 is adapted to hold the pole-type member in an upright position.

Figure 3A:
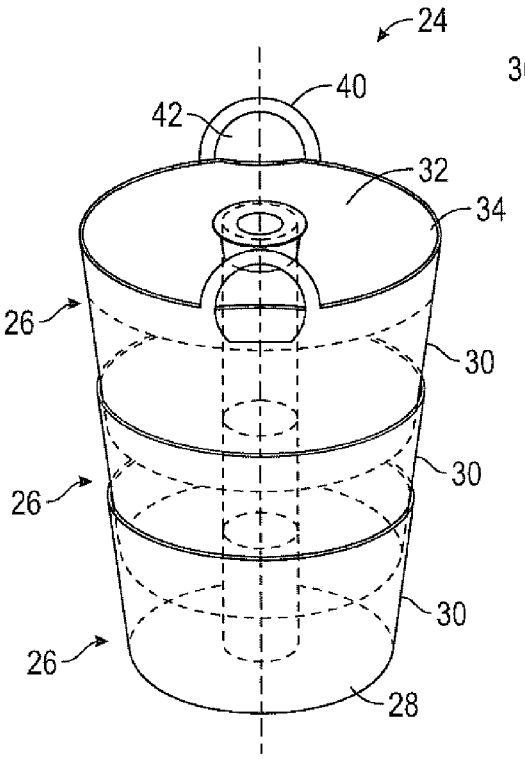
FIG. 3A is a perspective view of an adapter used with the stand of FIG. 1, in accordance with an embodiment of the present invention.
Figure 3B:
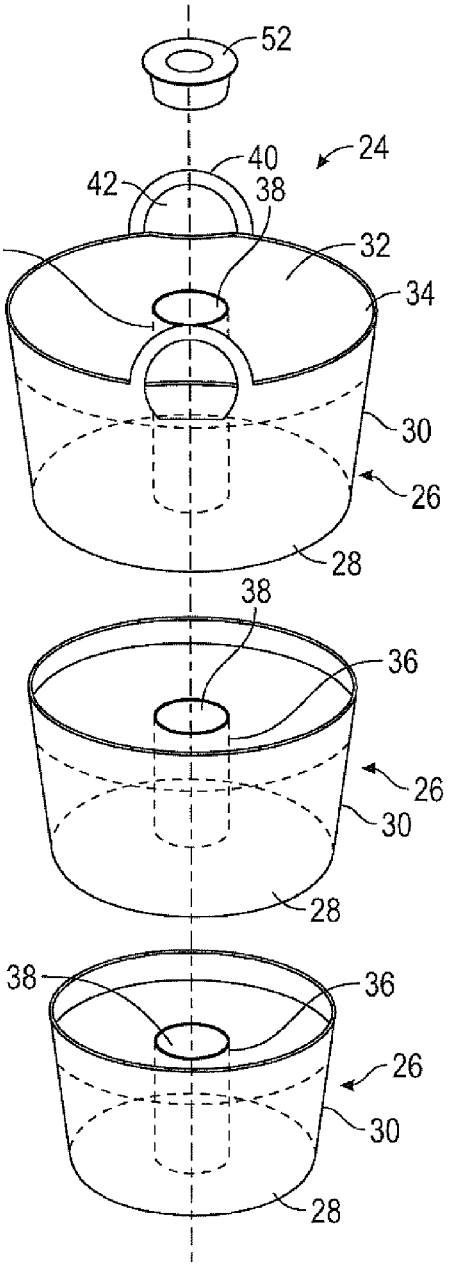
FIG. 3B is an exploded view of the adapter shown in FIG. 3A, in accordance with an embodiment of the present invention.

As may be seen in FIGS. 3A-3B, multiple holding members 26 may be stacked on top of one another. While FIGS. 3A-3B show three holding members 26 staked on top of each other, this is only shown as an example and should not be seen in a limiting manner. The holding members 26 may be sized and configured so that a bottom surface 28 fits within and slides into the open top area 34 of an adjacent holding member 26 located directly below. Since each of the holding members 26 are tapered and conically shaped, the holding members 26 may only slide a predetermined distance into the open top area 34 of the holding member 26 located directly below. Further, since the vertical support member 36 extends upward to an area below the open top area 34, the bottom surface 28 of the holding members 26 may sit on top of the vertical support member 36 an adjacent holding member 26 located directly below.

When multiple holding members 26 are stacked on top of one another, the vertical support members 36 of adjacent holding members 26 may be axially aligned. This may allow adjacent vertical support members 32 to receive a portion of a pole-type member to hold the pole-type member in an upright position.

In accordance with one embodiment, when multiple holding members 26 are stacked on top of one another, the uppermost holding members 26 may have one or more lifting tabs 40. The lifting tabs 40 may be used to pick-up and remove the multiple holding members 26 from the cut-out 16. In accordance with one embodiment, the tabs 40 may be located on opposing ends of the uppermost holding members 26. The tabs 40 may have an open opening 42 formed through a central area thereof, The opening 42 may allow a person to insert one or more fingers into the opening 42 in order to remove the holding members 26 from the cut-out 16.

The holding members 26 may be used to support the ring members 22. When one or more of the holding members 26 are positioned in the cut-out 16, a ring member 22 may be placed on a top edge of the sidewall 30 forming the uppermost holding members 26. The top edge of the sidewall 30 may provide support for holding the ring member 22 in place.

The adapter 24 may have a plug 52. The plug 52 may be placed in the top opening 38 of the vertical support member 32. The plug 52 may be used when the adapter is not being used to prevent debris from entering into the vertical support member 32.

Figure 4A:
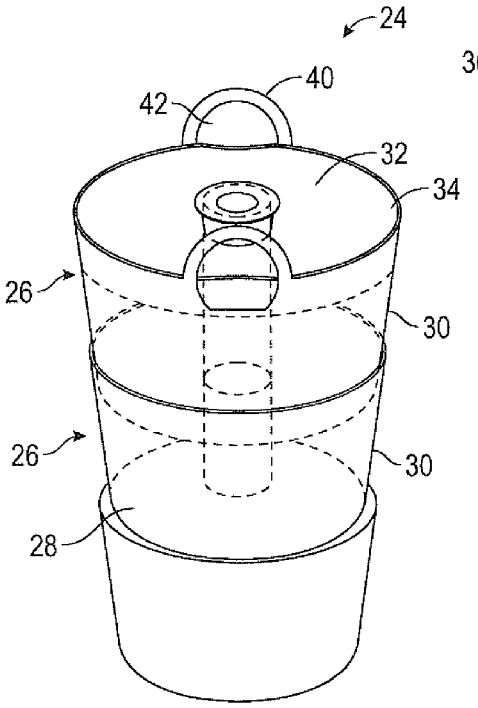
FIG. 4A is a perspective view of one embodiment of an adapter used with the stand of FIG. 1, in accordance with an embodiment of the present invention.
Figure 4B:
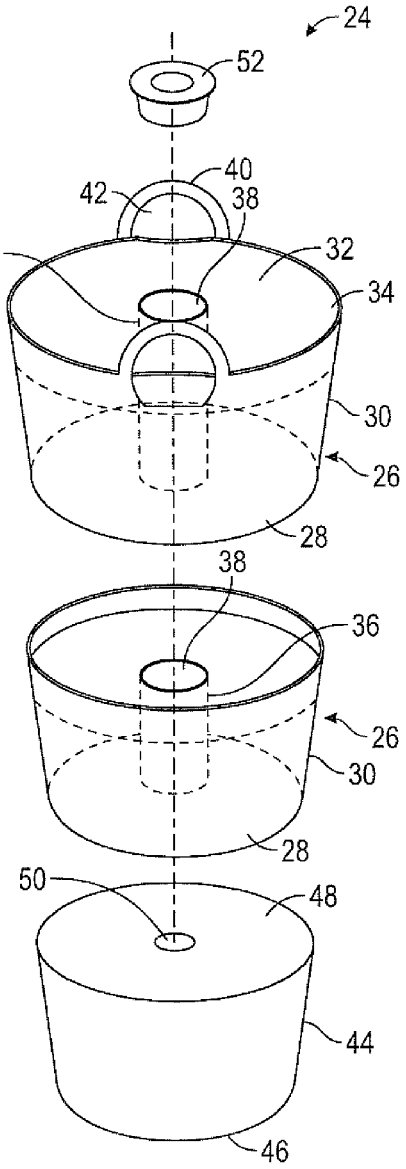
FIG. 4B is an exploded view of the adapter shown in FIG. 4B, in accordance with an embodiment of the present invention.

Referring now to FIGS. 4A-4B, in this embodiment, multiple holding members 26 may be stacked on top of one another similar to the embodiment shown in FIGS. 3A-3B. In the present embodiment, two holding members 26 may be stacked on top of each other. However, this is only shown as an example and should not be seen in a limiting manner. Each holding member 26 may be similar in size and shape to the cut-out 16. Thus, in accordance with one embodiment, each of the holding members 26 may be conical in shape so that a top diameter of the holding member 26 may be larger than a bottom diameter of the holding member 26.

The holding member 26 may include a bottom surface 28. The bottom surface 28 may be circular in shape. Sidewalls 30 may extend up and away from a central area of the bottom surface 28 to form a conical container having a hollow interior 32 having an open top area 34.

A vertical support member 36 may extend up from the bottom surface 28 of the holding member 26. The vertical support member 36 may extend up from a central area of the bottom surface 28 of the holding member 26 to an area below the open top area 34. In accordance with one embodiment, the vertical support member 32 may extend up from a central area of the bottom surface 28 of the holding member 26 to a height of approximately three-fourths of the way up to the open top area 30.

The vertical support member 32 may be cylindrical in shape, having a top opening 38. The top opening 38 may be circular in shape. The vertical support member 36 may be adapted to receive a portion of a pole-type member (not shown), including an artificial Christmas tree, some other type of artificial tree, an umbrella, a tiki torch, or some other elongated pole-type member. When such a pole-type member is positioned in the vertical support member 36, the vertical support member 36 is adapted to hold the pole-type member in an upright position.

As may be seen in FIGS. 4A-4B, multiple holding members 26 may be stacked on top of one another. While FIGS. 4A-4B show two holding members 26 staked on top of each other, this is only shown as an example and should not be seen in a limiting manner. The holding members 26 may be sized and configured so that a bottom surface 28 fits within and slides into the open top area 34 of an adjacent holding member 26 located directly below. Since each of the holding members 26 are tapered and conically shaped, the holding members 26 may only slide a predetermined distance into the open top area 34 of the holding member 26 located directly below. Further, since the vertical support member 36 extends upward to an area below the open top area 34, the bottom surface 28 of the holding members 26 may sit on top of the vertical support member 36 an adjacent holding member 26 located directly below.

When multiple holding members 26 are stacked on top of one another, the vertical support members 36 of adjacent holding members 26 may be axially aligned. This may allow adjacent vertical support members 32 to receive a portion of a pole-type member to hold the pole-type member in an upright position.

In accordance with one embodiment, when multiple holding members 26 are stacked on top of one another, the uppermost holding members 26 may have one or more lifting tabs 40. The lifting tabs 40 may be used to pick-up and remove the multiple holding members 26 from the cut-out 16. In accordance with one embodiment, the tabs 40 may be located on opposing ends of the uppermost holding members 26. The tabs 40 may have an open opening 42 formed through a central area thereof, The opening 42 may allow a person to insert one or more fingers into the opening 42 in order to remove the holding members 26 from the cut-out 16.

The holding members 26 may be used to support the ring members 22. When one or more of the holding members 26 are positioned in the cut-out 16, a ring member 22 may be placed on a top edge of the sidewall 30 forming the uppermost holding members 26. The top edge of the sidewall 30 may provide support for holding the ring member 22 in place.

The adapter 24 may have a plug 52. The plug 52 may be placed in the top opening 38 of the vertical support member 32. The plug 52 may be used when the adapter is not being used to prevent debris from entering into the vertical support member 32.

A platform 44 may be positioned below the multiple holding members 26. The platform 44 may be sized and configured to fit within a bottom section area of the cut-out 16. In accordance with one embodiment, the platform 44 is conical in shape such that a bottom area 46 has a smaller diameter and/or width than a top area 48. The platform 44 may have a channel 50 formed there through. The channel 50 may be a tubular channel that may be formed down a central axis of the platform 44. The channel 50 may be aligned with the vertical support members 36 in order to receive a portion of a pole-type member (not shown). When such a pole-type member is positioned in the vertical support member 36 and the channel 50, the vertical support member 36 and channel 50 may hold the pole-type member in an upright position.

Figure 5B:
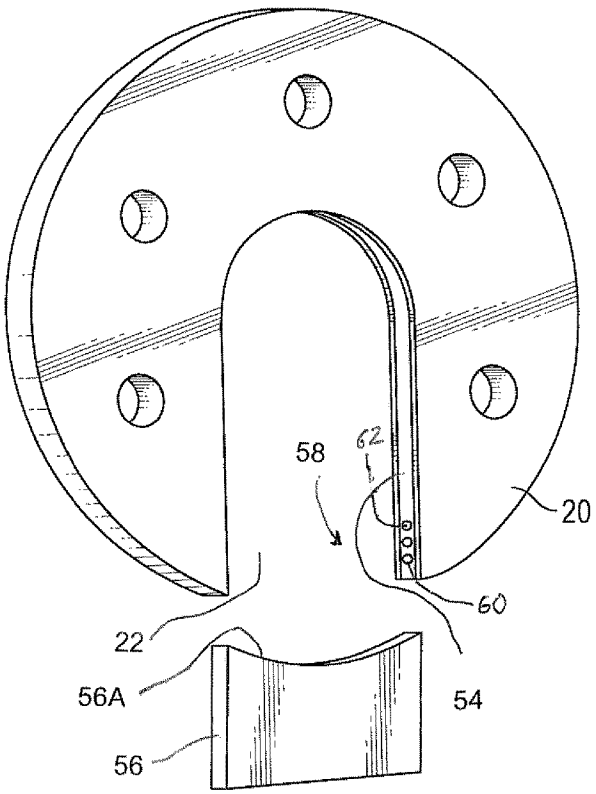
FIG. 5B is a perspective view of the adapter ring with the locking tab removed used with the stand shown in FIG. 1, in accordance with an embodiment of the present invention.
Figure 5A:
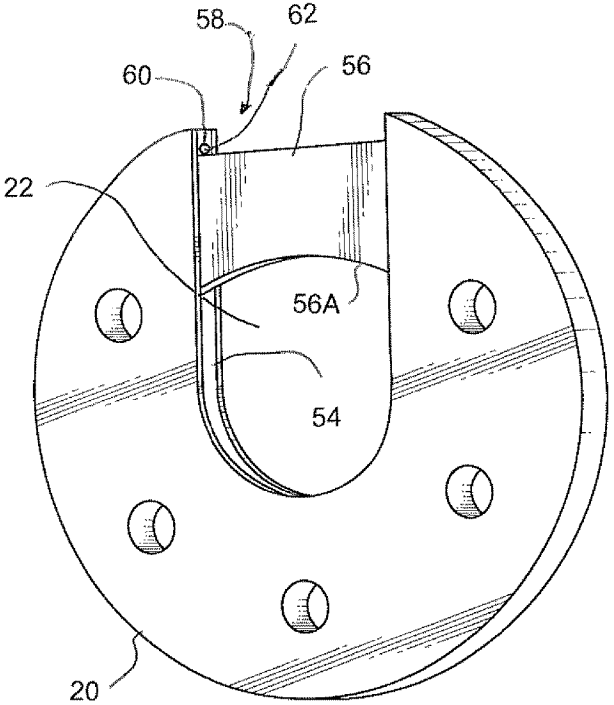
FIG. 5A is a perspective view of an adapter ring with a locking tab used with the stand shown in FIG. 1, in accordance with an embodiment of the present invention.

Referring to FIG. 5A-5B, a ring member 20 may be seen. The ring members 20 may come in a plurality of different diameters. Since the cut-out 16 may be conical in shape, the plurality of ring members 20 may be inserted into and held within the cut-out 16. Thus, one or more ring members 20 may be sized to fit in a lower section of the cut-out 16, one or more ring members 20 may be sized to fit in a middle section of the cut-out 16, and one or more ring members 22 may be sized to fit in an upper section of the top section of the cut-out 16 so as to be approximately flush with a top surface of the receptacle body 12.

Each ring member 20 may have a slot 22 formed therein. The slot 22 may be "U" shaped and may be sized to fit around the pole-type member 18 having an approximately equal width. A channel 54 may be formed around an inner perimeter of the slot 22. The channel 54 may be used to allow a locking tab 56 to be slid within the slot 22.

The locking tab 56 may be used to secure the pole-type member 18 within the slot 22 to prevent the pole-type member 18 from moving and/or leaning while positioned within the stand 10. The locking tab 56 may have an inward facing curve edge 56A. The inward facing curve edge 56A may be used to engage and hold the pole-type member 18 against the bottom of the edge of the "U" shaped slot 22.

A locking device 58 may be used to secure the locking tab 56 in place within the slot 22. In accordance with one embodiment, the locking device 58 may have a plurality of openings 60 formed within the channel 54. A locking pin 62 may be positioned within one of the openings 60 to secure the locking tab 56 in place and prevent the locking tab 56 from sliding out of the slot 22.

Figure 6:
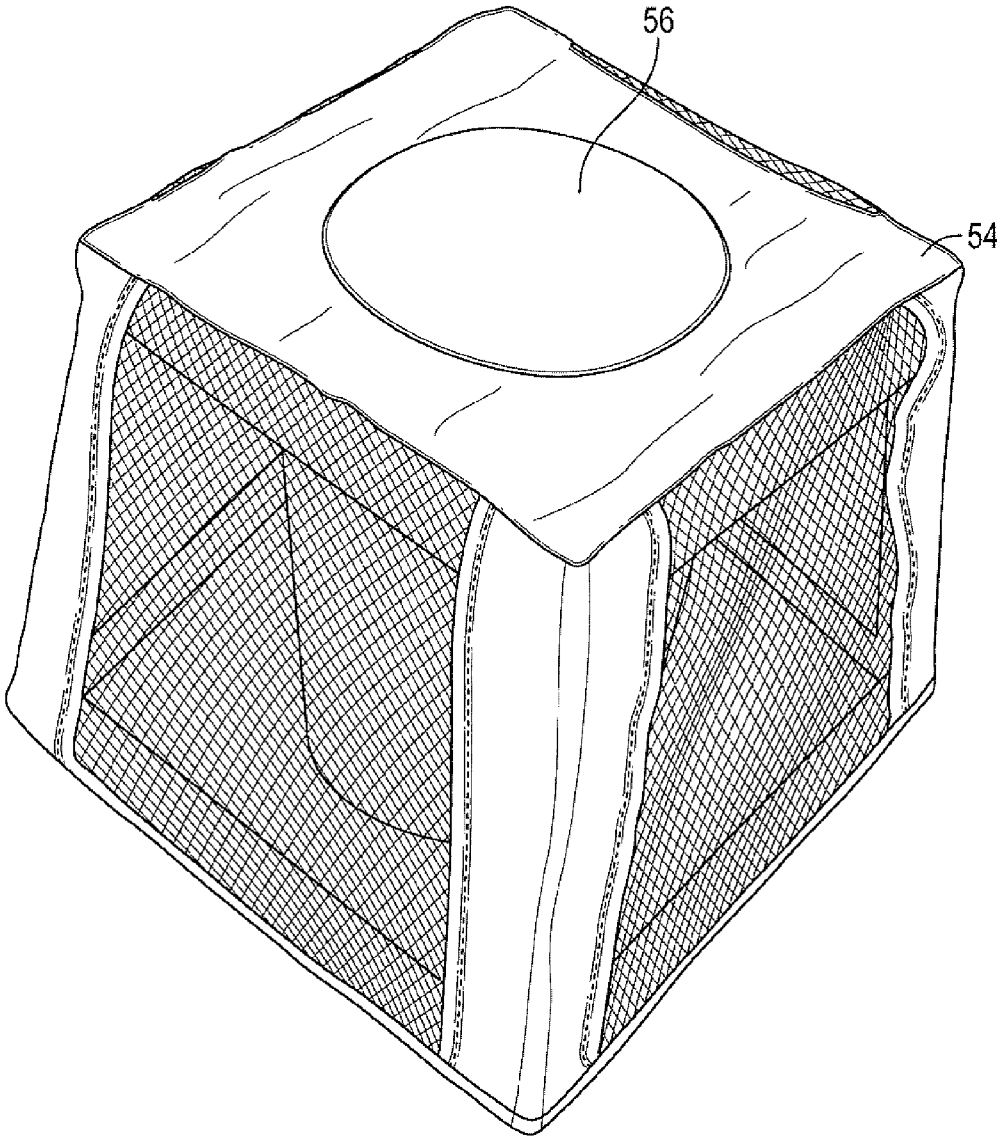
FIG. 6 is a perspective view of a cover used with the stand shown in FIG. 1, in accordance with an embodiment of the present invention.

Referring to FIG. 6, the stand 10 may have a cover 54. The cover 54 may be configured to fit over the stand 10. The cover 54 may be slightly tapered to conform to the shape of the receptacle body 12. The cover 54 may have a pole receiving opening 56 formed in a top section therein. The opening 56 may be formed in a central area of the top section of the cover 54. The opening 56 may be circular in shape but may be formed in other configurations without departing from the spirit and scope of the present discourse. The opening 56 may lead to the cut-out 16 formed in the interior of the receptacle body 12.

While embodiments of the disclosure have been described in terms of various specific embodiments, it will be recognized and understood by those skilled in the art that the embodiments of the disclosure may be practiced with modifications without departing from the spirit and scope of the invention.

What is claimed is:

1. A pole type member support device comprising:

a receptacle having an opening formed in a top section thereof, the receptacle being tapered so that the top section of the receptacle is smaller than a bottom section of the receptacle;

a tubular cut-out formed within the receptacle and extending down from the opening, wherein the tubular cutout is tapered so that the top section of the tubular cut-out is larger than a bottom section of the tubular cut-out; and an adapter positioned within the tubular cut-out, the adapter configured to hold a pole-type member in an upright position; at least one ring member, wherein the ring member has a slot formed therein, the slot having a diameter approximately equal to a diameter of a pole-type member, the ring member configured to be inserted and held within the tubular cut-out to support the pole-type member in an upright position within the tubular cut-out.

2. The pole type member support device in accordance with claim 1, comprising a cover having an opening formed in a top section thereof, the cover being sized to fit over the receptacle.

3. The pole type member support device in accordance with claim 1, wherein the adapter comprises plurality of holding members, wherein the plurality of holding members are stacked together.

4. The pole type member support device in accordance with claim 3, wherein each of the plurality of holding members comprises:

a conical-shaped base member having a circular-shaped bottom surface, a sidewall extending up from the bottom surface forming a hollow interior having an open top, the base member tapered so that a top section of the base member is larger than a bottom section; and a cylindrical-shaped vertical support member extending upwardly from a central area of the bottom surface, the support member adapted to receive a portion of a pole-type member for holding the pole-type member in an upright position.

5. The pole type member support device in accordance with claim 4, wherein the cylindrical-shaped vertical support member of each holding member is aligned when the plurality of holding members are positioned on top of one another.

6. The pole type member support device in accordance with claim 4, wherein an uppermost holding member comprises a tab member formed on opposing sides of the uppermost holding member.

7. The pole type member support device in accordance with claim 4, wherein the adapter comprises a platform positioned within the tubular cut-out to raise the adapter to a predetermined level.

8. The pole type member support device in accordance with claim 1, comprising a locking tab slidable within the slot, the locking tab supporting the pole-type member in an upright position within the slot.

9. A pole type member support device comprising:

a receptacle having an opening formed in a top section thereof, the receptacle being tapered so that the top section of the receptacle is smaller than a bottom section of the receptacle;

a tubular cut-out formed within the receptacle and extending down from the opening, wherein the tubular cutout is tapered so that the top section of the tubular cut-out is larger than a bottom section of the tubular cut-out; and an adapter positioned within the tubular cut-out, the adapter configured to hold a pole-type member in an upright position, wherein the adapter comprises a plurality of holding members, the plurality of holding members stacked together, wherein each of the plurality of holding members comprises:

a conical-shaped base member having a circular-shaped bottom surface, a sidewall extending up from the bottom surface and away from a central area of the bottom surface, the base member tapered so that a top section of the base member is larger than a bottom section; and a cylindrical-shaped vertical support member extending upwardly from the central area of the bottom surface and configured to receive a portion of a pole-type member to hold the pole-type member in an upright position; at least one ring member, wherein the ring member has a slot formed therein, the slot having a diameter approximately equal to a diameter of a pole-type member, the ring member configured to be inserted and held within the tubular cut-out to support the pole-type member in an upright position within the tubular cut-out.

10. The pole type member support device in accordance with claim 9, comprising a locking tab slidable within the slot, the locking tab supporting the pole-type member in an upright position within the slot.

11. The pole type member support device in accordance with claim 9, comprising a cover having an opening formed in a top section thereof, the cover being sized to fit over the receptacle.

12. The pole type member support device in accordance with claim 9, wherein the cylindrical-shaped vertical support member of each holding member is aligned when the plurality of holding members are stacked together.

13. The pole type member support device in accordance with claim 9, wherein an uppermost holding member comprises a tab member formed on opposing sides of the uppermost holding member.

14. The pole type member support device in accordance with claim 9, wherein an uppermost holding member comprises a plug.

15. The pole type member support device in accordance with claim 9, wherein the adapter comprises a platform positioned within the tubular cut-out to raise the adapter to a predetermined level.

16. A pole type member support device comprising:

a receptacle having an opening formed in a top section thereof, the receptacle being tapered so that the top section of the receptacle is smaller than a bottom section of the receptacle;

a tubular cut-out formed within the receptacle and extending down from the opening, wherein the tubular cutout is tapered so that the top section of the tubular cut-out is larger than a bottom section of the tubular cut-out;

an adapter positioned within the tubular cut-out, the adapter configured to hold a pole-type member in an upright position, wherein the adapter comprises a plurality of holding members, the plurality of holding members stacked together, wherein each of the plurality of holding members comprises:

a conical-shaped base member having a circular-shaped bottom surface, a sidewall extending up from the bottom surface and away from a central area of the bottom surface, the base member tapered so that a top section of the base member is larger than a bottom section; and a cylindrical-shaped vertical support member extending upwardly from the central area of the bottom surface and configured to receive a portion of a pole-type member to hold the pole-type member in an upright position;

at least one ring member, wherein the ring member has a slot formed therein, the slot having a diameter approximately equal to a diameter of a pole-type member, the ring member configured to be inserted and held within the tubular cut-out to support the pole-type member in an upright position within the tubular cut-out, wherein the at least one ring member is positioned on top of an uppermost base member of the adapter; and a locking tab slidable within the slot, the locking tab supporting the pole-type member in an upright position within the slot.

17. The pole type member support device in accordance with claim 16, comprising a cover having an opening formed in a top section thereof, the cover being sized to fit over the receptacle.

18. The pole type member support device in accordance with claim 16, wherein the adapter comprises a platform positioned within the tubular cut-out to raise the adapter to a predetermined level.

* * * * *